US005081779A

United States Patent [19]

Pack

[11] Patent Number: 5,081,779

[45] Date of Patent: Jan. 21, 1992

[54] FIREARM SAFETY LOCK

[76] Inventor: Harold R. Pack, P.O. Box 926, Chewelah, Wash. 99109

[21] Appl. No.: 713,408

[22] Filed: Jun. 11, 1991

[51] Int. Cl.[5] ..... F41A 17/02

[52] U.S. Cl. ..... 42/70.11

[58] Field of Search ..... 42/70.01, 70.08, 70.11

[56] References Cited

U.S. PATENT DOCUMENTS

| | | | |
|---|---|---|---|
| 633,939 | 9/1899 | Ackerman . | |
| 667,051 | 1/1901 | Ackerman . | |
| 2,994,981 | 8/1961 | Carrigan . | |
| 3,462,869 | 8/1969 | Wallace | 42/70.11 |
| 3,553,877 | 1/1971 | Welch et al. . | |
| 3,673,725 | 7/1972 | Cravener . | |
| 3,735,519 | 5/1973 | Fox . | |
| 3,882,622 | 5/1975 | Perlotto . | |
| 4,136,475 | 1/1979 | Centille . | |
| 4,261,127 | 4/1981 | Karkkainen | 42/70.11 |
| 4,384,420 | 5/1983 | Von Muller . | |
| 4,457,091 | 7/1984 | Wallerstein | 42/70.11 |
| 4,488,370 | 12/1984 | Lemelson | 42/70.01 |
| 4,532,729 | 8/1985 | Von Muller | 42/70.11 |
| 4,763,431 | 8/1988 | Allan et al. . | |
| 4,845,870 | 7/1989 | Vernon | 42/70.08 |
| 4,967,502 | 11/1990 | Vernon | 42/70.08 |

FOREIGN PATENT DOCUMENTS

| | | | |
|---|---|---|---|
| WO82/02941 | 2/1982 | PCT Int'l Appl. . | |
| 227630 | of 1925 | United Kingdom | 42/70.01 |

*Primary Examiner*—Charles T. Jordan
*Assistant Examiner*—Richard W. Wendtland
*Attorney, Agent, or Firm*—Wells, St. John & Roberts

[57] ABSTRACT

A safety lock is described for weapons in which the safety lock includes a rigid housing 20 enclosing a hammer spring 27 and plunger 28. The plunger 28 receives an end of a hammer pin 34 either supplied with the weapon, or the present lock 19. The hammer pin is received through an opening at the top end of the rigid housing 20 to engage and press axially against the plunger 28. The plunger 28 includes a plunger shaft 31 that extends along the spring axis through the spring to a rotatable cam 37 (62) which may be selectively moved by a lock assembly 47 to shift between a position in which a recess is aligned with the plunger, thereby allowing the plunger to move axially and permit operation of the weapon, or to position a lock surface 40 in alignment with the plunger, for abutting the plunger and successfully locking the plunger in position so the associated hammer pin and hammer may not be operated.

16 Claims, 7 Drawing Sheets

FIREARM SAFETY LOCK

TECHNICAL FIELD

The present invention relates to safety devices for firearms and more particularly to such devices that selectively prevent hammer operation in such firearms.

BACKGROUND OF THE INVENTION

There has been a constant need for safety devices in firearms to prevent accidental discharge. There is also a growing need to disable firearms to prevent intentional use of the firearms as when such firearms are stolen. To this end, various locking devices have been developed to lock the firearm trigger mechanism and thereby prevent operation of the firearm. For example, various devices are available on the market that will connect to the trigger housing of a firearm, locking the housing against access to the firearm trigger. However, such apparatus must be mounted to and removed from the firearm. The firearm is not disabled by the locking device but is simply rendered inoperable while the locking mechanism is in place on the trigger guard. Thus, a relatively simple operation with a hand drill or saw will facilitate removal of the lock and leave the firearm in operable condition. Further, such mechanisms, since they are removable from the firearm, are easily misplaced and lost.

It is therefore desirable to provide some form of locking mechanism that may be either integrated with the firearm or retrofitted to existing firearms that will remain with the firearm and that will disable the firearm completely both in the locking condition and if the locking device is removed from the firearm. Several devices have been patented that represent attempts to fill the above need.

U.S. Pat. No. 4,384,420 to Von Muller discloses a magazine lock for firearms. This device replaces the magazine of "clip" type firearms for purposes of locking the magazine. The lock does not carry ammunition and is not a permanent fixture on the weapon. When the weapon is in use, the lock must be removed. This apparatus is therefore somewhat similar in utility to the trigger guard locks discussed above.

U.S. Pat. No. 3,882,622 to Perlotto discloses a locking device to lock a weapon safety latch mechanism into position. The device requires a key to operate the weapon. The locking device is fitted into the weapon body and requires extensive tooling unless the weapon is manufactured with the lock in place.

U.S. Pat. No. 3,735,519 to Fox discloses a locking device that prevents movement of the weapon's safety to a firing position. This is said to prevent the weapon from firing. The lock includes a combination tumbler requiring that the proper combination of numbers be arranged to disconnect the lock and allow the sear to pivot away from the bolt and thereby enable the bolt to move. This device, again, must either be manufactured with the weapon or would require extensive modification of the weapon for retrofit installation.

U.S. Pat. No. 4,763,431 to Allen discloses another form of combination lock device that mounts to the hand grip mechanism of a firearm. This mechanism is utilized to lock the firing mechanism until a prescribed number sequence is pushed into the handle-mounted push button system. The apparatus is extremely complex and bulky with numerous mechanisms and backup mechanisms used to lock the operating elements of the weapon.

U.S. Pat. No. 2,994,981 to Carrigan discloses a locking device that is built into the hand grips of a revolver for the purpose of selectively locking out the hammer function. As with many other devices, the lock is used simply to temporarily lock the hammer mechanism which, otherwise, will operate freely. If drilled through, the locking device will become inoperable and allow the weapon to function normally.

U.S. Pat. No. 3,673,725 to Cravener discloses a useful locking arrangement using a key device which selectively positions a hammer rod obstruction into the rearward path of the weapon's hammer. The obstruction will successively prevent the hammer from being withdrawn and will therefore operate as an effective safety device. However, the device may be removed from the weapon, and leave the weapon completely operable.

U.S. Pat. No. 3,553,877 to Welch discloses a firearm safety device that makes use of a key lock mechanism and actuator arm for shifting a lever into position preventing movement of the weapon's safety from the safe to the fire position. Like Cravener, this apparatus is functional to the degree that it will operate when in proper position within the weapon. However, when the device is removed, the weapon is free to operate in a normal manner.

International Patent Application WO82/02941 (PCT/EP82/00070) discloses a security device which includes a bolt obstruction that is pivoted into position by a toggle mechanism. Once again, removal of the locking mechanism will permit free operation of the weapon.

U.S. Pat. No. 4,136,475 to Centille discloses a safety device for firearms including a key operated lock. The lock releases a locking pin that, when shifted to a locking position, prevents the firearm trigger from operating. The device makes use of a rack-and-pinion gear linkage activating member with a locking pin movable responsive to operation of the rack-and-pinion linkage to slide into engagement with the trigger seat. It is assumed that, since the disclosure relates only to the trigger seat, removal of the locking mechanism would permit free operation of the weapon.

U.S. Pat. Nos. 667,051 and 633,939 to Ackerman both disclose locking devices for shotgun "brake" levers. Operation with a key selectively moves a pin into position within a socket in the brake lever to lock the brake lever in position and thereby prevent the weapon from being opened. To disable the locking device, a simple procedure may be utilized to simply remove the locking pin. Operation of the weapon can then be accomplished in a normal manner.

The above references clearly disclose the long felt need for locking devices for firearms to prevent their unintentional use, and in some cases, their intended use by undesirable parties. However, these apparatus do not provide a totally effective solution. Most, if not all, may be fairly easily disabled to facilitate operation of the weapon in a normal manner. Others are extremely complicated and would add significantly to the cost and maintenance of the weapon. Still others are complex in operation and may not be reliable. The need has therefore remained for a simple, effective, and reliable safety device for firearms in which a locking mechanism is provided to prevent operation of the firearm and dismemberment or attempted removal of the locking device will result in further disruption of the firing mechanism for the associated weapon.

BRIEF DESCRIPTION OF THE DRAWINGS

Preferred forms of the present invention are illustrated in the accompanying drawings, in which:

FIG. 17 is a view of the present lock mounted within a lever action rifle.

DETAILED DESCRIPTION OF THE PREFERRED EMBODIMENTS

Figure 1:
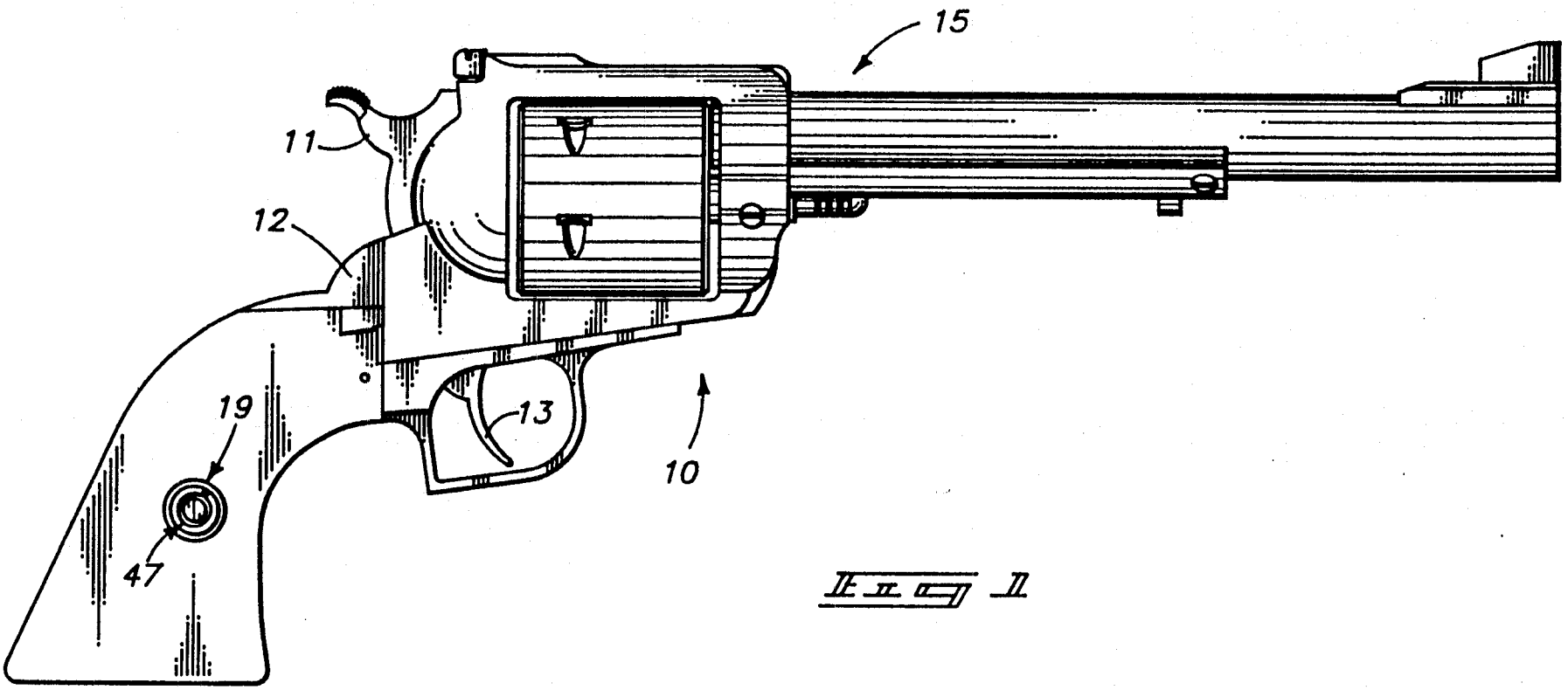
FIG. 1 is a side elevation view of a single action revolver incorporating a first preferred form of the present locking device.

This disclosure of the invention is submitted in furtherance of the constitutional purposes of the Patent Laws "to promote the progress of science and useful arts" (Article 1, Section 8).

The present invention is provided for utilization with a number of different weapons. Several firearms are designated in the drawings by the reference numeral 10 to generally indicate the broad utility of the invention. While these firearms are shown specifically, it should be understood that the present device may be utilized with numerous other forms of firearms, including shotguns (both hammer and hammerless types) and other weapons that will be clearly understood that may be utilized with the present safety devices.

In general, the generic firearm 10 will include a hammer 11 mounted within a firearm frame 12 for actuation by a trigger 13. For general information, a single-action revolver is shown 15 in FIG. 1; a semiautomatic type pistol is shown at 16 in FIG. 14; and a portion of a "lever action" rifle is shown at 17 in FIG. 17. The above weapons 15, 16, 17 are simply exemplary of the generic firearm 10, it being understood that others may be utilized as indicated above.

The present firearm safety lock is generally indicated in the drawings by the reference numeral 19. The present safety lock may be provided in different configurations or embodiments to adapt to various firearms 10. However, all embodiments include similar elemental features described below.

The safety lock 19 generally includes a rigid housing 20 for securing a hammer spring 27 in place in an inaccessible manner. To this end, the rigid housing 20 includes a tubular member 21 covered at one end by a top plate 22. The top plate 22 is affixed as by welding or other permanent securing means to the tube 21. Plate 22 includes an opening 23 formed therein.

The opposite end of the tube 21 includes a bottom block 24 for receiving the locking mechanisms to be described below.

The entire housing 20, including the tube 21, bottom block 24, and top plate 22, is intended to be provided substantially as integral components to provide a secure and inaccessible storage and support frame for an enclosed hammer spring 27.

The hammer spring 27 is enclosed within the housing for resilient deflection along a spring axis. It is advantageous that the hammer spring be a helical compression spring. The compression spring may be selected as compatible with the forms of springs currently used for driving hammer pins in hammer type weapons. The resiliency of the spring may be selectively adjusted either by substitution with various forms of other springs to accommodate the requirements of weapons to be utilized therewith, or may be adjustable as by shim stock, adjusting screws, etc. (not shown).

It is the intent that the hammer spring 27 be selected to replace the existing spring mechanism in existing weapons such that the original hammer spring may be discarded and that the present locking arrangement be placed into position within the weapon as exemplified in FIGS. 8, 9, 14, and 17.

In weapons manufacturing situations, the present locking arrangement will be assembled with the weapon and therefore not require removal and discard of an existing spring.

A plunger 28 is movably received within the rigid housing 20. Plunger 28 includes a headed end 29 that receives an end of the hammer spring 27. It also includes an outwardly facing recess 30 that is preferably aligned with the top plate opening 23 and coaxial with the spring axis. Headed end recess 30 is utilized axially to receive an existing or provided hammer pin 34.

Figures 2, 3:
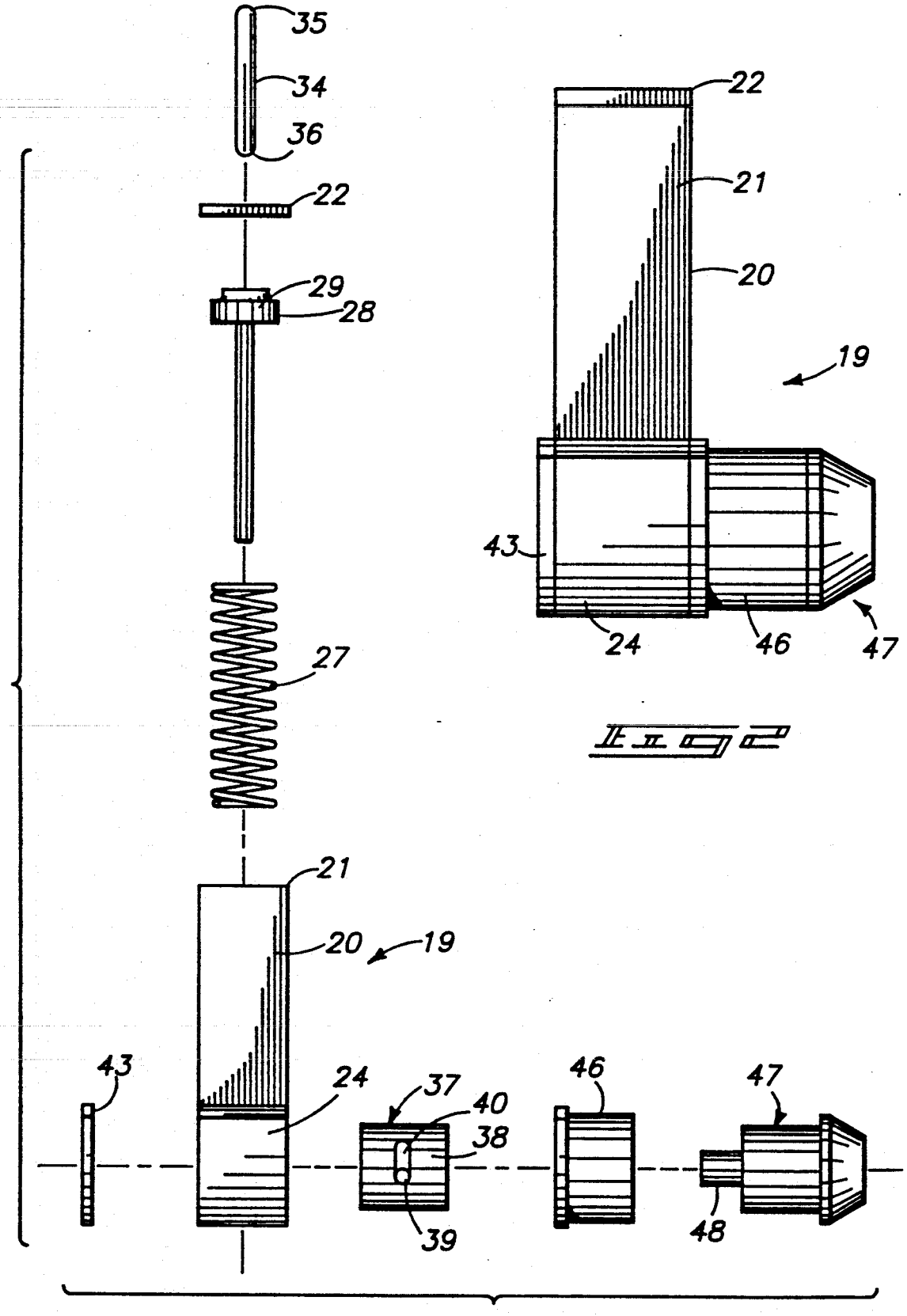
FIG. 2 is an enlarged elevation view of the first preferred form of the locking device.
FIG. 3 is an exploded view of the first preferred form shown in FIG. 2.
Figure 8:
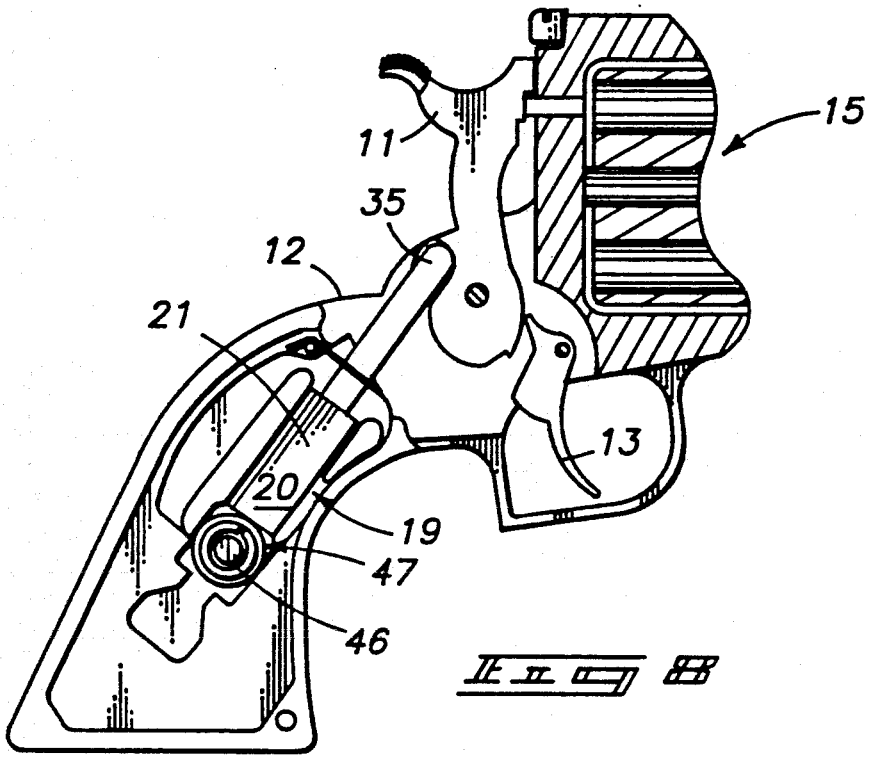
FIG. 8 is a fragmented sectional view showing the locking device in an operative "locked" position in a single-action revolver.
Figure 9:
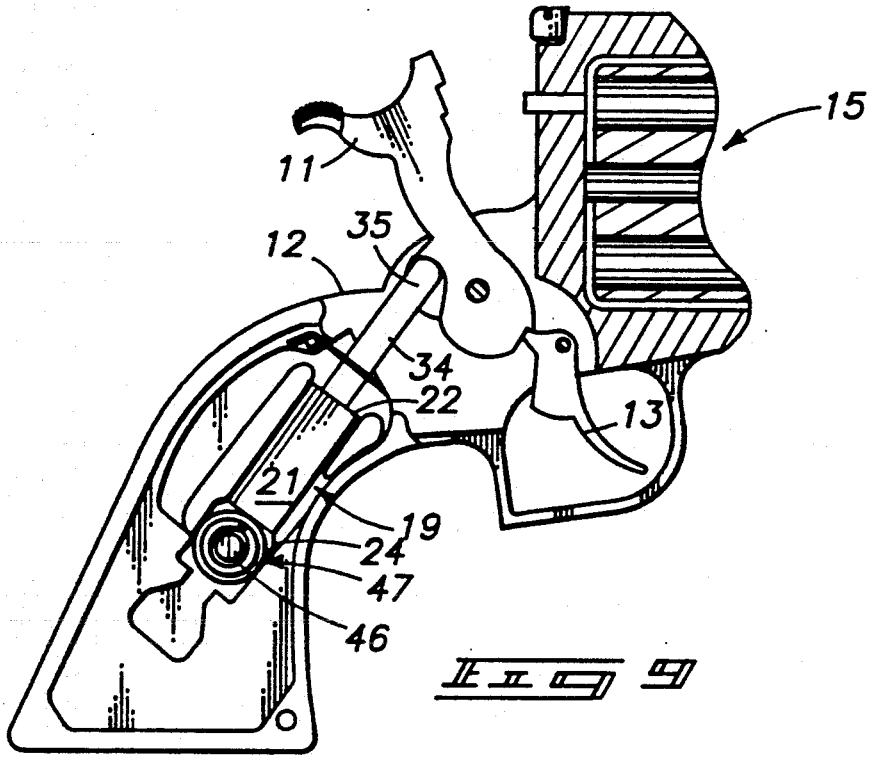
FIG. 9 is a view similar to FIG. 8 only showing the hammer in a "cocked" position.
Figure 12:
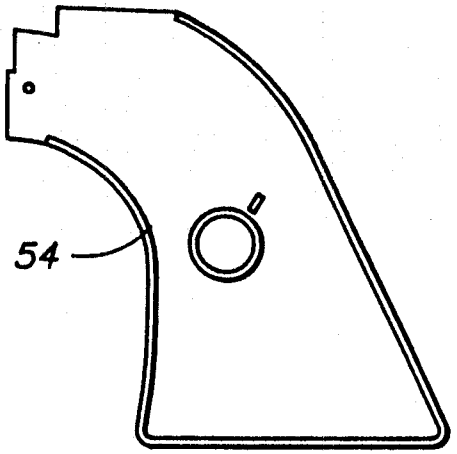
FIG. 12 is a view of the opposite hand grip to that shown in FIG. 11.

The hammer pin 34 is shown in FIGS. 8 and 9 connected to the present safety lock 19 and independently in FIG. 3. It is pointed out that various hammer pins may be utilized with the present invention. For example, a hammer pin or pins may be supplied with the present safety lock as an element of a retrofit package. Alternatively, the existing hammer pin manufactured with the weapon may be utilized. In either instance, the hammer pin will include one end 35 for selectively engaging the weapon hammer or hammer actuator, and a remaining end 36 engaging the plunger 28. This combination, with the releasable, somewhat articulated fit between the hammer pin 34 and plunger 28 will be useful in most instances as there may be some angular disparity between the axis of the spring when mounted in the weapon, and the line or arc of movement for the hammer pin. In other instances, it may be quite feasible to integrate the plunger and hammer pin as a single unit.

Figure 4:
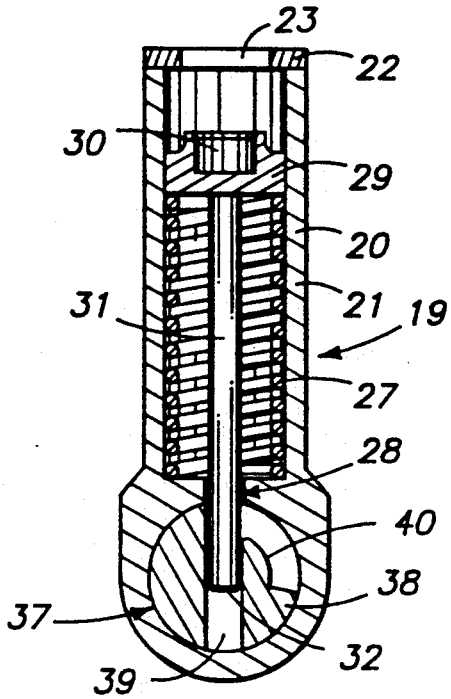
FIG. 4 is a sectional view of the locking device and showing the spring and plunger mechanism in a "cocked" condition.
Figure 6:
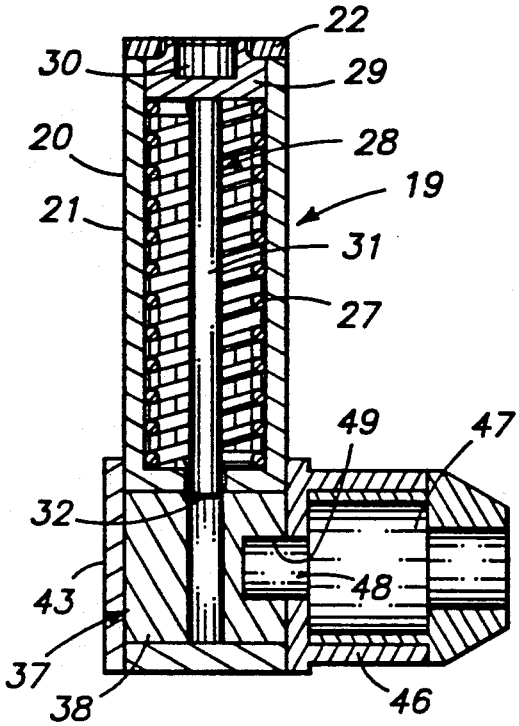
FIG. 6 is a sectional view taken on line 6—6 in FIG. 5.
Figure 5:
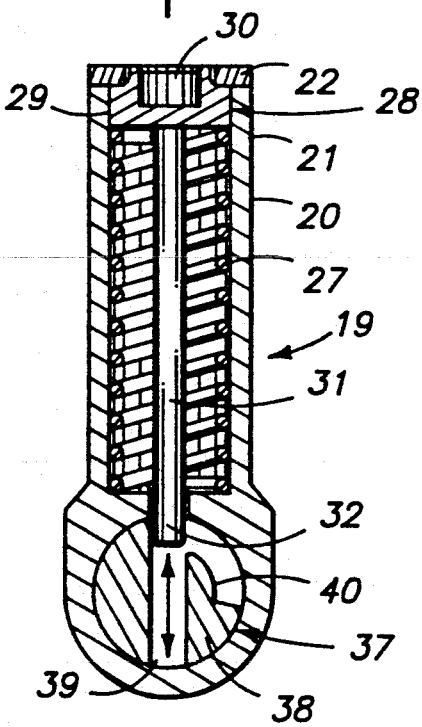
FIG. 5 is a sectional view through the assembled locking device in an unlocked condition.

A cam 37 is mounted within the bottom block 24. In a preferred configuration, the cam 37 includes a circular cam block 38 with a recess 39 formed therein that is movable to an unlock position to allow the plunger shaft to act against and deflect the hammer spring 27. This position is identified in FIGS. 4, 5, and 6 in sectional views. FIG. 4 shows the spring deflected and the plunger 28 received with the recess 39. This position would correspond to a "cocked" condition of the hammer as, for example, shown in FIG. 9. The unlocked, ready to cock orientation is shown in FIGS. 5 and 6. These positions reflect the unlocked position which enables normal usage of the associated firearm 10.

Figure 7:
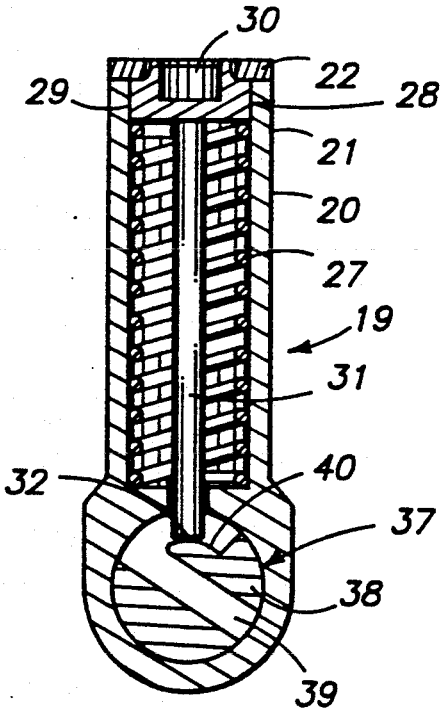
FIG. 7 is a view similar to FIG. 5 only showing the spring and plunger mechanism is a "locked" position.

The circular cam block 38 also includes a lock surface 40 formed therein. Surface 40 is shown rotated to in an operative position in FIG. 7 and in an inoperative position in FIGS. 4 and 6. The lock surface is substantially semicircular, formed on the rotational axis of the circular cam block 38. The surface 40 may be selectively rotated into the locking orientation shown in FIG. 7 by simple rotation of the cam block 38. Surface 40 at that time obstructs axial motion of the plunger 28 and thereby prevents compression of the spring 27. The spring 27 is thereby selectively locked out of operation. Furthermore, the plunger 28 and hammer pin 34 become rigidly connected to the weapon frame 12 to prevent motion of the hammer to a cocked position. The weapon is therefore completely locked from operation.

The circular cam block 38 is permanently rotatably mounted within the bottom block 24 by provision of a cover 43 on one side of the block and by a lock mechanism housing 46 on the opposite side. These elements are welded or otherwise permanently secured to the lock device to prevent access to and removal of the cam block 38.

The cam 37 is selectively shifted between the locking and unlocking positions by a lock means generally shown at 47. Lock means 47 is mounted to the lock mechanism housing 46 with an operator or actuator 48 engaging the cam 37 to rotate the cam 37 and selectively shift its recess 39 or lock surface 40 into position with respect to the plunger 28. The lock is preferably key operated. However, other forms of conventional locking mechanisms may be utilized as well.

A preferred lock mechanism is the 720 model distributed by Lock America of 7251-M Garden Grove Boulevard, Garden Grove, Calif. The above mechanism may be installed with little alteration securely within the lock mechanism housing in a permanent manner so the entire lock 19 becomes an integrated unit.

The configuration of the assembly shown in FIGS. 2–9 and 17 is such that the unit may be easily installed within existing firearms to replace the existing hammer spring, whether it be a compression type helical spring, or a leaf type spring as typically found in revolvers. The configuration is such that the unit may be simply slipped into place where the prior spring was positioned and releasably held within the firearm frame. The hammer pin 34, whether existing or supplied, is easily fitted to the hammer in the usual manner. The device is therefore retrofitted to a wide range of existing firearms without requiring modification of the firearm structure.

Figure 13:
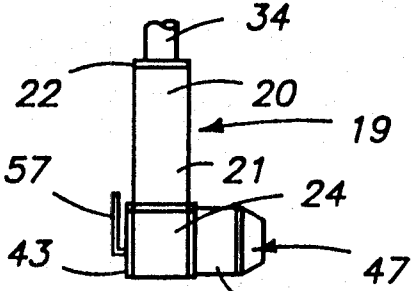
FIG. 13 illustrates a locking arrangement for the hand grips shown in FIGS. 11 through 12.
Figure 10:
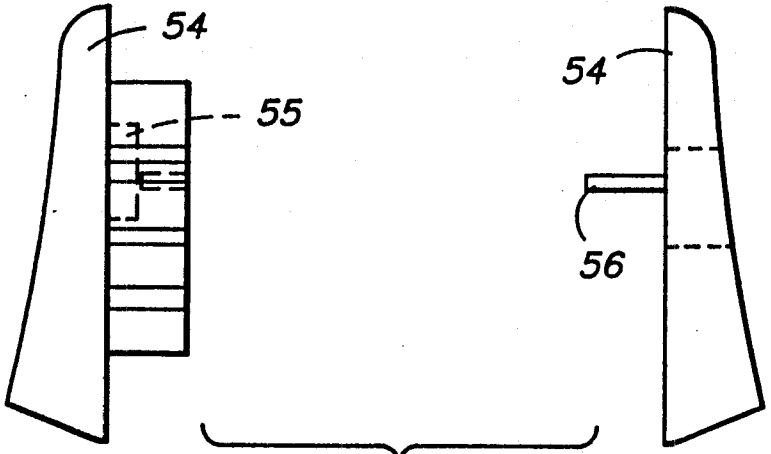
FIG. 10 is an exploded view of a pair of hand grips with hand grip locking features.
Figure 11:
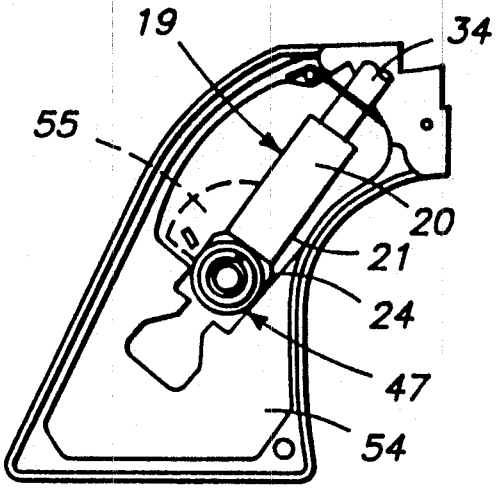
FIG. 11 is a side view of one of the locking hand grip sections with a lock installed thereon.

Addition provision may be made to prevent access to the lock 19 when secured in the operative, locked condition. This arrangement is illustrated in FIGS. 10–13 in which a modified version of the lock 19 is shown including a grip locking dog 57 (FIG. 13). The dog 57 is simply comprised of an arm extending outwardly from the internal circular cam block. The grip locking dog 57 therefore will selectively rotate as the internal cam block rotates responsive to rotation of a key.

The locking dog 57 is selectively received within an appropriate slot or groove 55 formed on one side of a pair of hand grips 54. The dog 57 will therefore selectively lock the hand grip in place on the associated weapon frame.

The opposite hand grip may include a laterally extending pin 56 that is received within an appropriate opening in the opposite grip for engagement by the locking dog 57. This grip is therefore also securely locked to the weapon frame when the lock mechanism is shifted to its operative, locked orientation.

Thus, the hand grips are securely locked to the weapon and become relatively integrated with the lock 19, further securing the weapon against intentional and unintentional use. The hand grips 54 are intended to simply replace existing grips without significantly altering the shape or "feel" of the grips. The only noticeable difference will be the opening for the lock housing and for key access.

Figure 14:
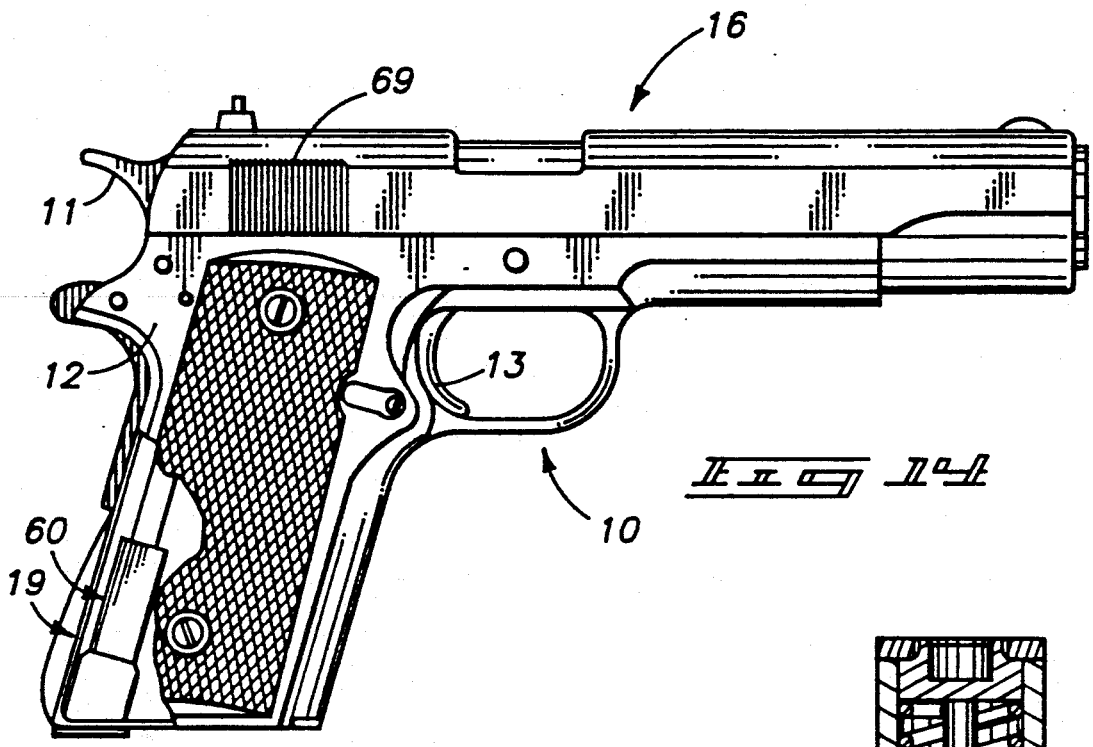
FIG. 14 illustrates a semiautomatic pistol with another preferred form of the present locking mechanism mounted therein.
Figure 15:
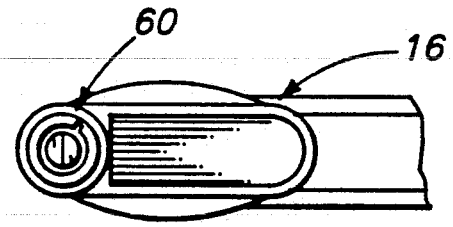
FIG. 15 is a bottom plan view of the hand grip area of the semiautomatic weapon showing the present lock in place thereon.
Figure 16:
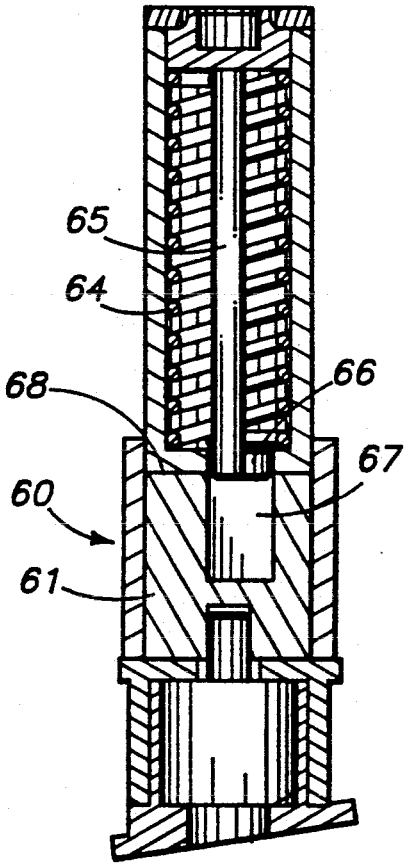
FIG. 16 is a detail view of locking components for the semiautomatic locking arrangement shown in FIGS. 14 and 15.
Figure 11:
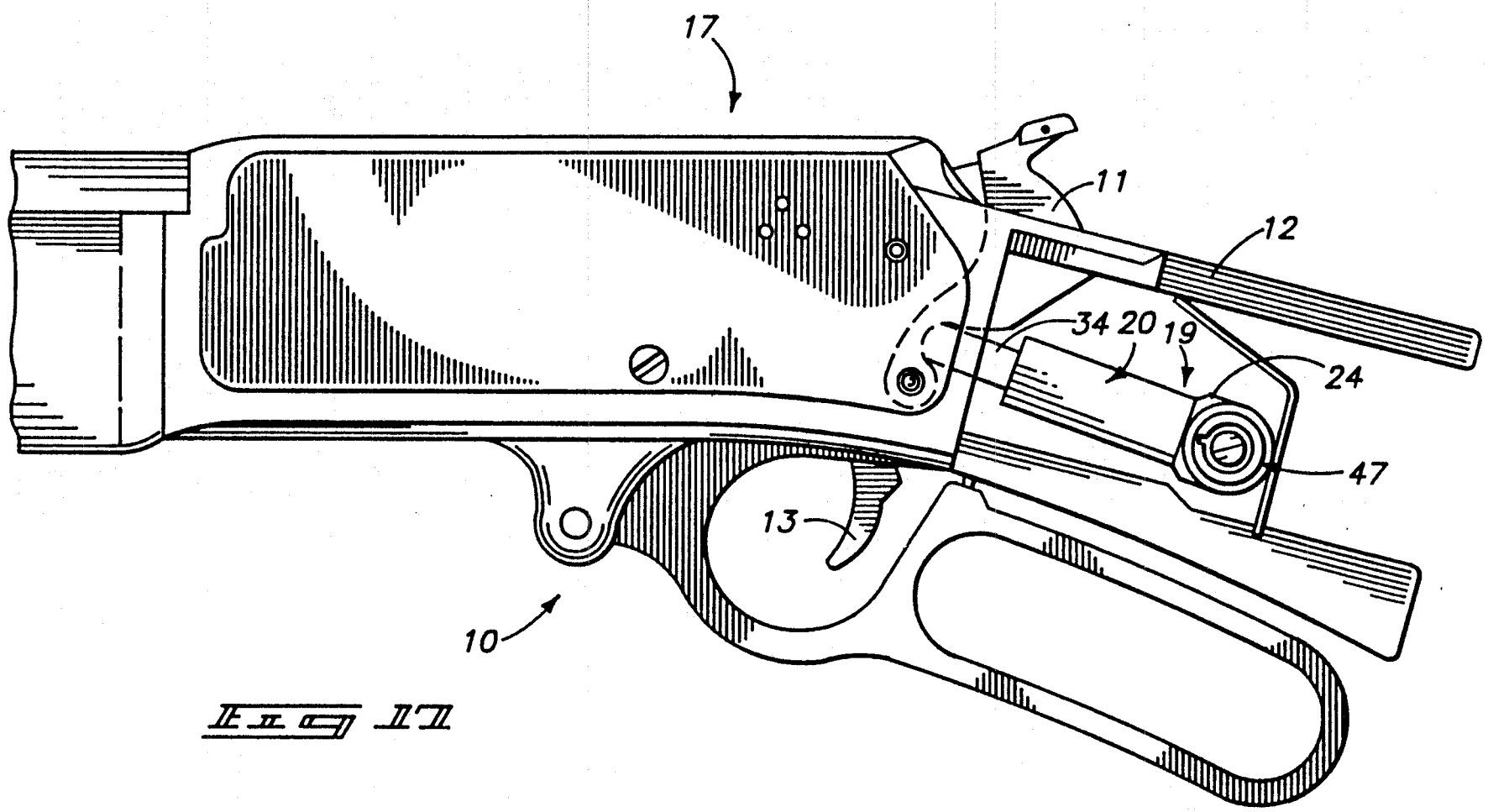

An alternative form of lock body 60 is shown in FIGS. 14–16. Here, the alternative lock body includes a coaxial cam block 61 (FIG. 16). The block is substantially coaxial with the internal spring 64 and is rotatable to selectively lock or unlock the associated plunger 65 in a manner substantially similar to that described above. To this end, the plunger 65 may include an appropriate offset shoulder 66 selectively received within a recess 67 formed in the lock block, or, in the locked orientation, the shoulder is received and abutted with a lock surface 68.

Regardless of the configuration or embodiment described above, installation of the present safety device is a simple matter. In retrofit situations, the firing spring system of the weapon is disassembled and the original hammer spring is removed. The hammer spring is then replaced with the present safety lock 19. Depending upon the installation, the existing hammer pin may be utilized, or a custom hammer pin 34 may be provided with the unit to complete the connection between the hammer spring and the weapon hammer. Next, a hole is drilled within the adjacent frame or hand grip area of the weapon to receive the lock housing 46. In most instances, the hole is drilled within the wood, plastic, or other soft material of the stock or hand grips. Once again, this is a relatively simple procedure and does not involve special tools or training. Upon completion of the hole, the weapon can be reassembled and the unit is ready for operation.

A key (not shown but typically supplied with the lock means 47) may be selectively utilized to lock the unit. When locked, the plunger is prevented from deflecting along the spring axis and the weapon hammer is therefore substantially rigidly connected to the weapon frame and will not move back to a cocked position. This therefore eliminates operation of the weapon completely as, in the case of a revolver, the cylinder will not turn and the trigger will not function. In the case of the lever action rifle shown in FIG. 17, the hammer will not move to the cocked position, nor can the lever be operated to move the bolt rearwardly to present the chamber for access by cartridges.

Similarly, the semiautomatic weapon 16 shown in FIG. 14 is disabled by the locking device 19 to the point where the hammer may not be moved to a cocked position, nor may the hammer slide 69 be shifted rearwardly to gain access to the barrel chamber. The weapon is therefore completely disabled until the key is used to shift the device to the unlocked position. Here, the locking surface is pivoted clear of the plunger and the weapon is allowed to be used in the normal operating condition.

If the weapon is stolen, and is in the locked condition, tampering with the lock mechanism will not result in a return of the weapon to normal operating conditions. If the user is successful in removing the hand grips or stock, a procedure which is difficult at best using the arrangement shown in FIGS. 10–13, the remainder of the locking mechanism presents itself as a formidable obstacle. Removal of the unit from the weapon renders the weapon inoperative, as the hammer spring and plunger are substantially integrated with the unit and are removed with the remaining of the lock mechanism. Thus, there would be no spring remaining to operate the hammer. An original spring would have to be supplied to return the weapon to the operative condition. Likewise, vandalism of the unit would not likely result in the unit returning to an operative position. This is true because the spring and plunger are encased within the unit and would likely be damaged by any vandalizing of the unit. The spring and plunger would therefore, without highly skilled, qualified operation, be rendered inoperable by attempted removal of the locking mechanisms.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A firearm safety lock device, comprising:

a hammer spring situated along an axis;

a rigid housing enclosing the hammer spring and having a hammer pin receiving opening formed therein along the axis;

a plunger having a shaft axially received within the housing and connected to the hammer spring for movement along the axis in opposition to bias of the hammer spring;

a cam mounted to the rigid housing adjacent the spring and including (a) a recess movable to an unlock position to allow the plunger shaft to act against the hammer spring to deflect the hammer spring; and (b) a lock surface movable to a locking position in the housing to abut the plunger shaft and prevent motion thereof to deflect the hammer spring; and lock means mounted to the housing and engaging the cam for selectively locking the cam in the locking position.

2. A firearm safety lock device as claimed by claim 1, further comprising:

hammer pin having a hammer actuating member at one pin end and a remaining pin end with a plunger engaging surface thereon extendable through the hammer pin receiving opening in the rigid housing to engage the plunger.

3. A firearm safety lock device as claimed by claim 1 wherein the cam is rotatable about a lock axis in the housing and the recess and lock surface are angularly spaced about the lock axis.

4. A firearm safety lock device for a firearm having a handgrip as claimed by claim 1 wherein the cam includes a grip locking dog thereon for selectively engaging and locking with the firearm hand grip with the locking surface in the locking position.

5. A firearm safety lock device as claimed by claim 1 wherein the hammer spring is a helical spring with a central longitudinal axis, and wherein the plunger shaft is axially received within the helical spring substantially coaxially with the helical spring axis.

6. A firearm safety lock device as claimed by claim 1 wherein the hammer spring is a helical compression spring with a central longitudinal axis, and wherein the plunger shaft is axially received within the helical compression spring substantially coaxially with the helical compression spring axis.

7. A firearm safety lock device as claimed by claim 1 wherein the cam is rotatable about a lock axis in the housing and the recess and lock surface are angularly spaced about the lock axis; and wherein the hammer spring is a helical spring with a central longitudinal axis, and wherein the plunger shaft is axially received within the helical spring substantially coaxially with the helical spring axis.

8. A firearm safety lock device as claimed by claim 1 wherein the cam is rotatable about a lock axis in the housing and the recess and lock surface are angularly spaced about the lock axis; and wherein the hammer spring is a helical compression spring with a central longitudinal axis, and wherein the plunger shaft is axially received within the helical compression spring substantially coaxially with the helical compression spring axis.

9. A firearm safety lock device for a firearm having a handgrip as claimed by claim 1 wherein:

the cam includes a grip locking dog thereon for selectively engaging and locking with the firearm hand grip with the locking surface in the locking position; and the hammer spring is a helical spring with a central longitudinal axis, and wherein the plunger shaft is axially received within the helical spring substantially coaxially with the helical spring axis.

10. A firearm safety lock device as claimed by claim 1 wherein the cam is rotatable about a lock axis in the housing and the recess and lock surface are angularly spaced about the lock axis; and wherein the hammer spring is a helical spring with a central longitudinal axis: and wherein the lock axis and the central longitudinal axis are substantially perpendicular to one another.

11. A firearm safety lock device as claimed by claim 1 wherein the cam is rotatable about a lock axis in the housing and the recess and lock surface are angularly spaced about the lock axis; and wherein the hammer spring is a helical spring with a central longitudinal axis: and wherein the lock axis and the central longitudinal axis are substantially coaxial with one another.

12. A firearm safety lock device, comprising:

a hammer spring for deflection along a spring axis;

a rigid housing enclosing the hammer spring and securing one end thereof;

a hammer pin having a hammer actuating member at one pin end and a remaining pin end extending into the housing;

a plunger shaft received within the housing having a headed end receiving the hammer spring and connected to the hammer pin for movement in opposition to bias of the hammer spring;

the plunger including a plunger shaft extending along the spring axis;

a cam mounted to the rigid housing adjacent the spring and including (a) a recess formed therein, movable to an unlocked position to axially receive the plunger shaft and thereby allow the plunger shaft to deflect the hammer spring; and (b) a lock surface movable to a locking position in the housing to abut the plunger shaft and prevent motion of the plunger shaft to deflect the hammer spring; and lock means mounted to the housing and engaging the cam for selectively locking the cam in the locking position.

13. A firearm safety lock device as claimed by claim 12 wherein the hammer pin includes:

a hammer actuator pin section; and a plunger movably mounted within the housing and having an end receiving the hammer actuator pin section.

14. A firearm safety lock device as claimed by claim 12 wherein the cam includes a grip locking dog thereon for selectively engaging and locking with a firearm hand grip with the locking surface in the locking position.

15. A firearm safety lock device as claimed by claim 12 wherein the hammer actuator pin section and plunger are separable elements.

16. In combination with a firearm including a hammer firing mechanism, a hammer spring safety lock device, comprising:

a frame;

a rigid housing mounted to the frame;

a hammer spring enclosed by the rigid housing for resilient deflection along a spring axis;

a hammer pin having a hammer actuating member at one pin end and a remaining pin end extending into the rigid housing;

a plunger shaft received within the housing by the hammer spring and connected to the spring for movement in opposition to bias of the hammer spring to deflect the hammer spring;

wherein the plunger shaft and the hammer pin are connected along the hammer spring axis;

a cam mounted to the rigid housing adjacent the spring and including (a) a recess formed therein, movable to an unlocked position to receive the plunger shaft and thereby allow the plunger shaft to deflect the hammer spring; and (b) a lock surface movable to a locking position in the housing to abut the plunger shaft and prevent motion of the plunger shaft to deflect the hammer spring; and lock means mounted to the housing and engaging the cam for selectively locking the cam in the locking position.

* * * * *